US005386684A

United States Patent [19]

Simon et al.

[11] Patent Number: 5,386,684

[45] Date of Patent: Feb. 7, 1995

[54] DATA EXCHANGE COORDINATING APPARATUS FOR A TEXTILE MACHINE

[75] Inventors: Karsten Simon; Norbert Coenen, both of Moenchengladbach, Germany

[73] Assignee: W. Schlafhorst & Co., Moenchengladbach, Germany

[21] Appl. No.: 984,277

[22] Filed: Dec. 1, 1992

Related U.S. Application Data

[63] Continuation of Ser. No. 880,298, May 5, 1992, abandoned, which is a continuation of Ser. No. 771,802, Oct. 7, 1991, abandoned, which is a continuation of Ser. No. 448,682, Dec. 11, 1989, abandoned.

[30] Foreign Application Priority Data

Dec. 9, 1988 [DE] Germany ..... 3841464

[51] Int. Cl.[6] ..... D01H 9/10; D01H 7/86

[52] U.S. Cl. ..... 57/264; 57/268

[58] Field of Search ..... 57/263, 264, 268, 278

[56] References Cited

U.S. PATENT DOCUMENTS

| | | | |
|---|---|---|---|
| 3,789,595 | 2/1974 | Bernstein et al. | 57/264 |
| 3,810,352 | 5/1974 | Miyazaki et al. | 57/263 |
| 4,028,869 | 6/1977 | Schaefer et al. | 57/34 R |
| 4,555,067 | 11/1985 | Angelucci et al. | 242/35.5 A |
| 4,640,088 | 2/1987 | Lattion | 57/263 |
| 4,653,262 | 3/1987 | Engeli | 57/264 X |
| 4,685,283 | 8/1987 | Slavik et al. | 57/263 |
| 4,703,617 | 11/1987 | Engeli et al. | 57/263 |
| 4,823,544 | 4/1989 | Igel | 57/264 X |
| 4,843,810 | 7/1989 | Kabilka et al. | 57/268 |
| 4,888,945 | 12/1989 | Maeda et al. | 57/264 |

FOREIGN PATENT DOCUMENTS

| | | |
|---|---|---|
| 0276651 | 1/1987 | European Pat. Off. . |
| 2455495A1 | 5/1976 | Germany . |
| 2647118A1 | 4/1977 | Germany . |
| 3040839A1 | 5/1981 | Germany . |
| 3012419A1 | 10/1981 | Germany . |
| 3340497A1 | 5/1985 | Germany . |
| 8321639 | 9/1985 | Germany . |
| 3417455A1 | 11/1985 | Germany . |
| 3325999C2 | 3/1989 | Germany . |
| 1538410 | 1/1979 | United Kingdom . |

*Primary Examiner*—Daniel P. Stodola
*Assistant Examiner*—William Stryjewski
*Attorney, Agent, or Firm*—Shefte, Pinckney & Sawyer

[57] ABSTRACT

A coordinating apparatus for insuring the proper positioning of the traveling service unit with a respective work station of a textile machine so that data such as, for example, information concerning the servicing requirements of the respective work station and operating instructions, can be communicated between the service unit and the work station.

10 Claims, 13 Drawing Sheets

Fig. 4
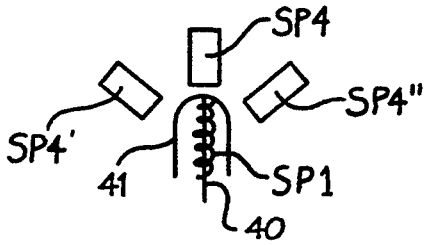
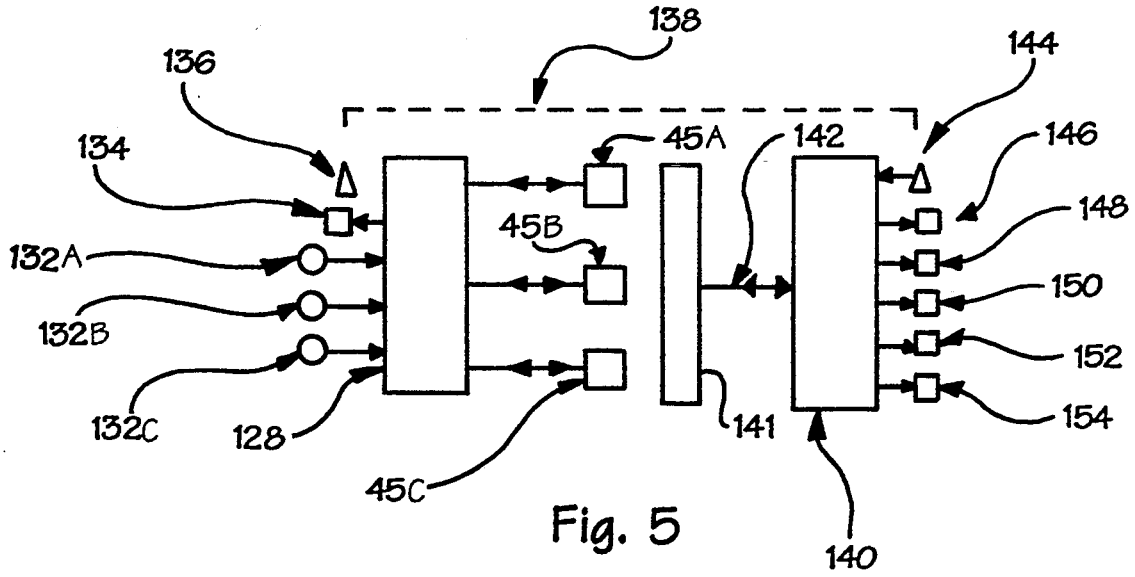
Fig. 5

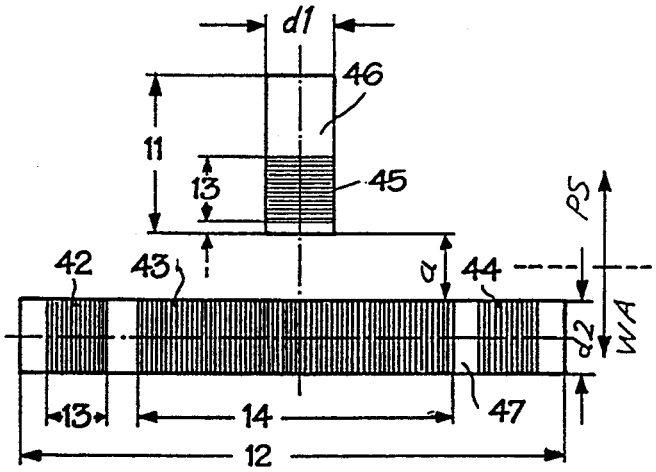
Fig. 8
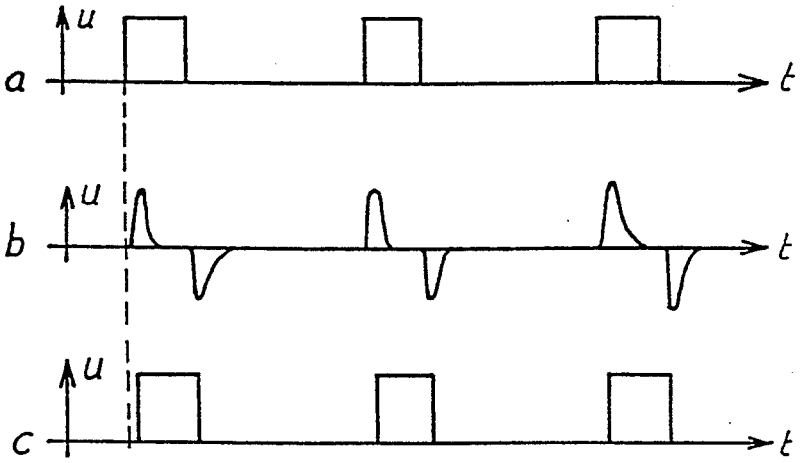
Fig. 9A
Fig. 9B
Fig. 9C

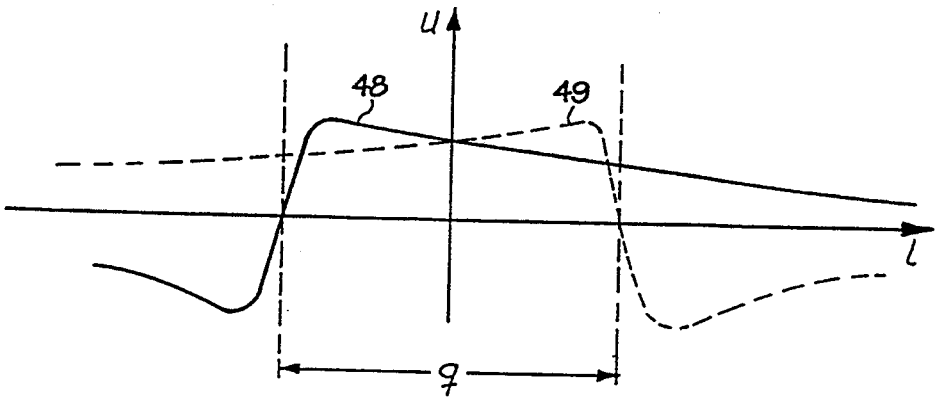
Fig. 10
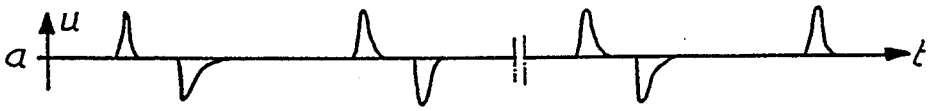
Fig. 11A
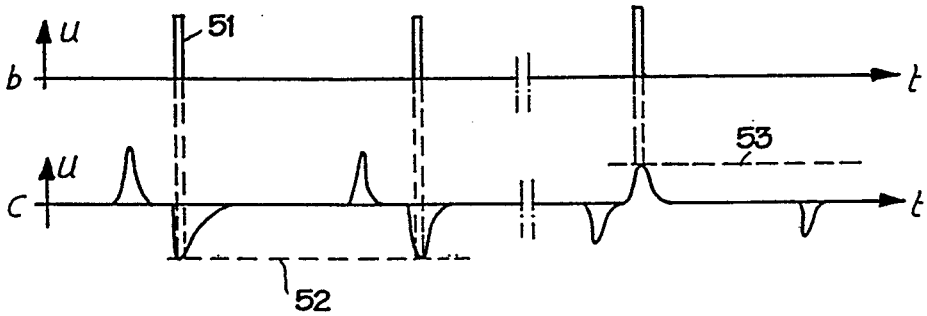
Fig. 11B
Fig. 11C

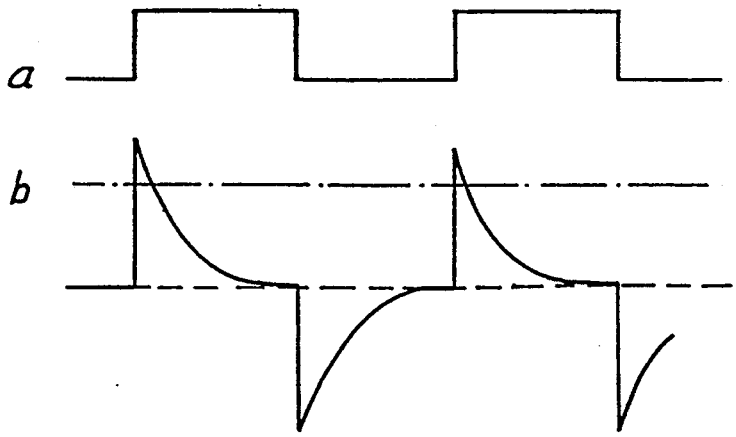
Fig. 17A
Fig. 17B
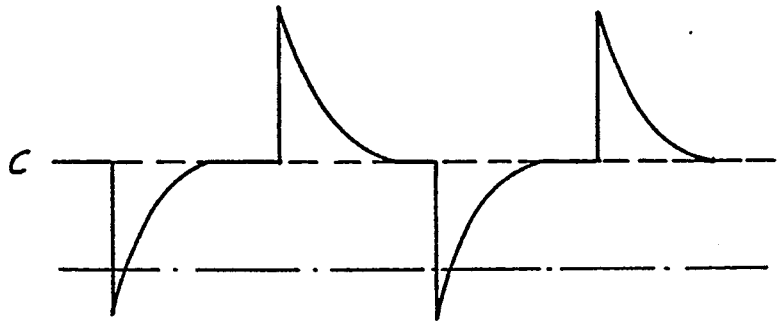
Fig. 17C
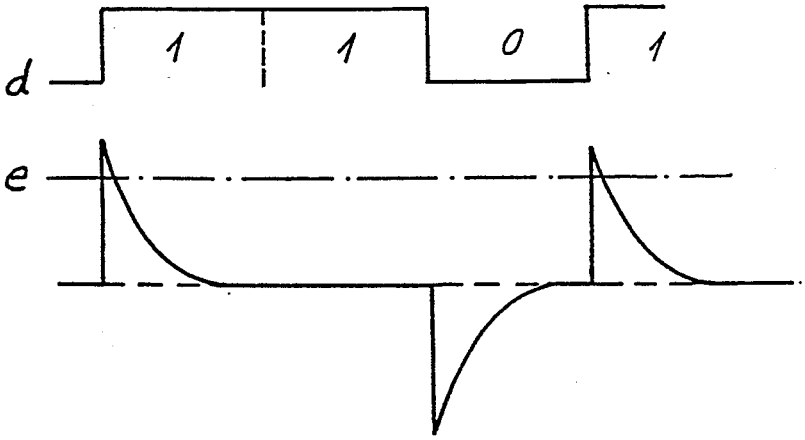
Fig. 17D
Fig. 17E

DATA EXCHANGE COORDINATING APPARATUS FOR A TEXTILE MACHINE

This a continuation of co-pending application Ser. No. 07/880,298, filed May 5, 1992, now abandoned, which is a continuation of co-pending application Ser. No. 07/771,802, filed Oct. 7, 1991, now abandoned, which is a continuation of co-pending application Ser. No. 07/448,682, filed Dec. 11, 1989, now abandoned.

BACKGROUND OF THE INVENTION

The present invention relates to a data exchange coordinating apparatus for a textile machine and, more particularly, to a data exchange coordinating apparatus for a textile machine of the type having a plurality of work stations and a traveling service unit.

It is known to provide a textile machine for producing cross-wound yarn packages such as, for example, a winding machine or an open-end spinning machine, with a traveling service unit for individually servicing the individual work stations of the textile machine at which a textile material such as, for example, yarn, is handled. The traveling service unit individually services the work stations in response to a service request requesting service for a respective individual work station. In response to the request for such servicing, the traveling service unit performs a servicing operation such as, for example, a yarn package exchange operation or the preparation of the work station for beginning another yarn handling operation.

It is known to use mechanical or electromechanical devices for requesting the traveling service unit to service a respective work station. For example, it is known to provide a metal plate and an initiator, each mounted to a respective one of the individual work stations to be serviced and the traveling service unit, for selectively stopping the traveling service unit at the respective work station to be serviced. When the traveling service unit has traveled to a position adjacent the respective work station such that the metal plate is within the reception range of the initiator, appropriate control means cause the traveling service unit to be maintained in position at the respective work station until the completion of its servicing operations. Thereafter, the traveling service unit travels to other work stations to perform servicing operations thereat.

However, the need still exists for a relatively simple apparatus for insuring the proper positioning of a traveling service unit at a respective work station to be serviced so that data relating to the particular servicing requirements of the respective work station can be communicated to the traveling service unit and operating instructions can be communicated from the traveling service unit to the respective work station.

SUMMARY OF THE INVENTION

The present invention provides a coordinating apparatus for insuring the proper positioning of a traveling service unit with a respective work station of a textile machine so that data such as, for example, information concerning the servicing requirements of the respective work station and operating instructions, can be communicated between the service unit to the work station.

The present invention provides a data exchange coordinating apparatus for a textile machine of the type having a plurality of work stations for individually handling a textile material and a traveling service unit for individually servicing the work stations, the work stations having operating control means for controlling the operations of the work stations and the traveling service unit having drive means for driving the service unit to and between the work stations and a control means including means for controlling the selective positioning of the service unit at a service position at a respective work station for servicing of the work station by the service unit.

The data exchange coordinating apparatus includes a work station signal means operatively connected to the operating control means of a work station for selectively transmitting signals from the operating control means and for relaying signals to the operating control means and a service unit signal means operatively connected to the control means of the traveling service unit for selectively transmitting signals from the traveling service unit and for receiving signals from the work station operating control means. The work station signal means and the service unit signal means define a system for the wireless, bi-directional transmission of signals between the work station and the traveling service unit whereby data relating to the servicing requirements of the work station and the servicing operations of the service unit can be exchanged between the work station and the service unit.

BRIEF DESCRIPTION OF THE DRAWINGS

FIG. 4 is a schematic plan view of one form of the work station antenna means of the data exchange coordinating apparatus of the present invention;

FIG. 5 is a schematic representation of another embodiment of the data exchange coordinating apparatus of the present invention;

FIG. 8 is a schematic view of the work station antenna means and the service unit antenna means of the another embodiment of the data exchange coordinating apparatus shown in FIG. 5;

FIG. 9 is a graphic representation of the transmission signals received by the rod antenna of the data exchange coordinating apparatus of the present invention;

FIG. 10 is a graphic representation of the overlapping of the transmission signals received by the rod antenna of the data exchange coordinating apparatus of the present invention;

FIG. 11 is a graphic representation of the needle impulses of the transmission signals received by the rod antenna of the data exchange coordinating apparatus of the present invention;

FIG. 17 is graphic representation of the characteristics of the signals produced by the further embodiment of the data exchange coordinating apparatus shown in FIG. 16;

DETAILED DESCRIPTION OF THE PREFERRED EMBODIMENTS

Figure 1:
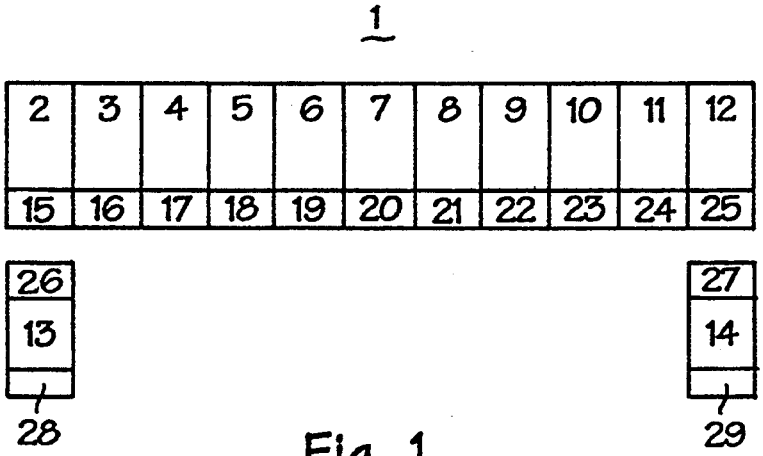
FIG. 1 is a schematic plan view of the work stations and the traveling service units of a textile machine and one embodiment of the data exchange coordinating apparatus of the present invention.
Figure 2:
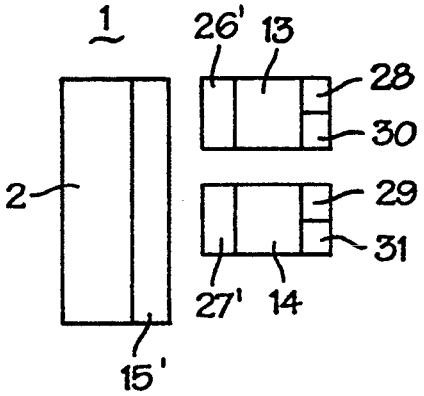
FIG. 2 is a schematic side elevational view of one of the work stations, the traveling service units and a portion of the data exchange coordinating apparatus of the present invention shown in FIG. 1.

In FIGS. 1 and 2, one embodiment of the data exchange coordinating apparatus of the present invention is illustrated. A textile machine 1 includes a plurality of individual work stations 2–12, each for individually handling a textile material such as, for example, yarn, and a pair of traveling service units 13 and 14. The traveling service units 13,14 each include a conventional drive assembly (not shown) for driving the service unit in opposed directions along the work stations 2–12. The traveling service units 13,14 travel to service positions adjacent respective ones of the work stations 2–12 for performing service operations at the individual work stations such as, for example, performing a yarn package exchange operation or preparing the respective work station for another yarn handling operation. Additionally, the traveling service units 13–14 operate in conventional manner to restore the individual work stations 2–12 to operating conditions following interruptions such as, for example, a yarn break, thereat.

The drive assemblies of the traveling service units 13,14 operate in conventional manner to drive the traveling service units along conventional traveling service unit guide rails (not shown) in such a manner that the traveling service units 13,14 are movable past one another whereby each traveling service unit can travel to each of the work stations 2–12 for performing an individual servicing operation thereat.

In accordance with the present invention, a data exchange coordinating apparatus is provided for coordinating the positioning of the traveling service units 13,14 at respective ones of the work stations 2–12 and for coordinating the transmission of data between the traveling service units and the work stations relating to the servicing of the work stations. As seen in FIG. 1, the data exchange coordinating apparatus includes a plurality of work station signal apparatuses 15–25, operatively connected to the work stations 2–12, respectively, a traveling service unit signal apparatus 26 operatively connected to the traveling service unit 13 and a traveling service unit signal apparatus 27 operatively connected to the traveling service unit 14. As seen in FIG. 2, each respective work station signal apparatus 15–25 is in the form of an integral signal unit such as, for example, the integral signal unit 15′, for simplified mounting of the work station signal apparatus 15 to the work station 2. Similarly, each traveling service unit signal apparatus 26,27 is mounted to its associated traveling service unit 13,14 in the form of an integral signal unit 26′, 27′, respectively. The traveling service unit 13 additionally includes a conventional drive assembly 28 for driving the traveling service unit between the work stations 2–12 in non-interfering manner with respect to the traveling service unit 14 and a conventional braking assembly 30 for selectively maintaining the traveling service unit 13 at a fixed position relative to a respective one of the work stations 2–12. Similarly, the traveling service unit 14 includes a conventional drive assembly 29 for driving the service unit between the work stations 2–12 in non-interfering manner with respect to the traveling service unit 13 and a conventional braking assembly 31 for maintaining the traveling service unit in a fixed position relative to a respective one of the work stations 2–12.

The conventional drive assemblies 28,29 can be, for example, in the form of conventional reversible drive motors which can be selectively reversibly driven to drive the associated traveling service unit 13,14 in opposed directions. The conventional braking assemblies 30,31 can be in the form, for example, of conventional braking devices which engage the drive assemblies 28,29, the drive wheels of the traveling service units or the traveling service unit guide rails to selectively brake the traveling service units 13,14 at respective service positions adjacent the work stations 2–12. The conventional braking assemblies 30,31 can in this regard, for example, be in the form of conventional air braking devices comprising solenoid or electromagnetic components which maintain resiliently biased brake shoes or the like out of engagement with the rotating shafts of the drive assemblies 28,29 so long as electric current is supplied to the solenoids or electromagnetic devices. Upon the de-activation of the electrical power supply to the drive assemblies 28,29, the solenoid or electromagnetic devices release the brake shoes from their withdrawn positions and the brake shoes are then resiliently moved by, for example, spring members, into braking contact with the rotating shaft of the drive assemblies 28,29. Upon further actuation of the energy or electrical supply to the drive assemblies 28,29, the solenoids or electromagnetic devices operate in conventional manner to withdraw the brake shoes from braking contact with the shaft of the drive assemblies 28,29

Figure 3:
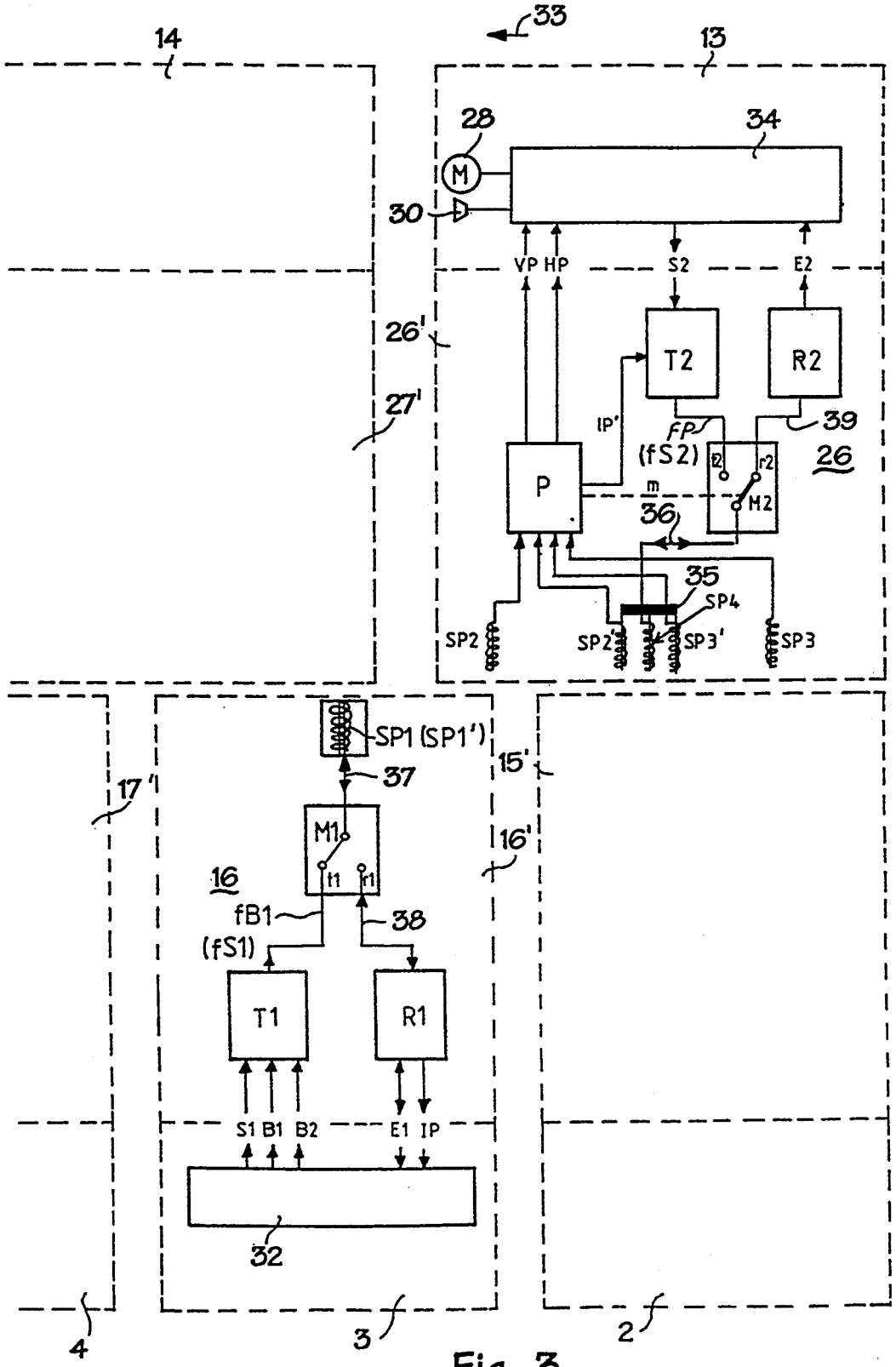
FIG. 3 is a schematic representation of a portion of the one embodiment of the data exchange coordinating apparatus of the present invention shown in FIG. 1 mounted to one of the traveling service units and a portion of the one embodiment of the data exchange coordinating apparatus of the present invention shown in FIG. 1 mounted to one of the work stations.

As seen in FIG. 3, the work stations 2–12 are oriented such that the work station integral signal units 15′, 16′, 17′ of the work stations 2–4 and the respective integral signal units (not shown) of the work stations 5–12 face outwardly along the side of the textile machine 1 with their outermost vertical surfaces in linear alignment The integral signal units 26′, 27′ of the traveling service units 13,14, respectively, are oriented in facing relationship with the work station integral signal units. Additionally, those surfaces of the integral signal units 26',27' which are most closely adjacent the work station integral signal units are oriented parallel to the outermost vertical surfaces of the work station integral signal units. Accordingly, the traveling service units 13,14 can travel relatively closely adjacent the work stations 2–12.

With further reference to FIG. 3, each work station signal apparatus 15–25 such as, for example, the signal apparatus 16, includes a service requesting means for generating a service request signal corresponding to a request for the positioning of one of the traveling service units 13,14 at a service position at the respective individual work station for performing a servicing operation thereat. Each traveling service unit 13,14 such as, for example, the traveling service unit 13, includes a travel control means for controlling the travel of the service unit in response to a service request signal requesting the positioning of the service unit at a service position at a respective one of the work stations 2–12.

The data exchange coordinating apparatus additionally includes data processing means mounted to the work stations and the traveling service unit for generating data signals corresponding to service operation data and for processing data exchange in the form of data signals between the work stations and the traveling service unit. The data exchange coordinating apparatus also includes transmission means mounted to the work stations and the service unit for the wireless transmission of service request signals and the data signals between the work stations 2–12 and the traveling service units 13,14.

As seen in FIG. 3, each work station signal apparatus 15–25 such as, for example, the signal apparatus 16, includes the service requesting means, the data processing means and the transmission means associated with the respective work stations such as, for example, the work station 3. Each traveling service unit signal apparatus 26,27 includes travel control means. Each of the work station signal apparatuses 15–25 such as, for example, the signal apparatus 16 associated with the work station 3, includes an antenna SP1 having an iron core. Additionally, the work station signal apparatus 16 includes a conventional electronic switch member M1, a conventional oscillator T1, a conventional transmitter-receiver member R1. The oscillator T1 and the transmitter-receiver member R1 are each operatively connected to the operating control means 32 of the work station 3 which can be, for example, a conventional microprocessor. The oscillator T1 is connected to the electronic switch M1 for delivering electrical current to the electronic switch. Likewise, the transmitter-receiver member R1 is electrically connected to the electric switch M1 for transmitting electrical current thereto. The electric switch M1 is electrically connected to the antenna SP1 for transmitting an electric current thereto.

The service unit signal apparatuses 26,27, such as the signal apparatus 26 representatively shown in FIG. 3, each include a left-handed antenna winding member SP2, and antenna winding assembly 35 having a ferrite antenna member SP4 centrally located between a pair of antenna windings SP2' and SP3' and a right-hand antenna winding member SP3. The antenna winding assembly 35 has an E-shaped form in which the antenna members SP2' and SP3' comprise the upper and lower extensions of the "E" and the antenna member SP4 comprises the middle extension of the "E". The antenna member SP4 is formed of suitable ferrous or ferrite magnetic material. Additionally, the service unit signal apparatus 26 includes an electronic positioning member P electronically individually connected to each antenna winding member SP2,SP2', SP3' and SP3. The service unit signal apparatus 26 also includes a conventional electric switch M2, a conventional oscillator T2 and a conventional transmitter-receiver member R2. The electronic positioning member P is electrically connected via a connector with the oscillator T2, which is electrically connected to the electric switch M2. The transmitter-receiver member R2 is also electrically connected to the electric switch M2.

The electric switch M2 is electrically connected via a connector 36 to the ferrite core of the antenna winding assembly 35. The electronic positioning member P, the oscillator T2 and the transmitter-receiver member R2 are individually electronically connected to the operating service unit control means 34 of the traveling service unit 13 which can, for example, be a conventional microprocessor. The operating service unit control means 34 is operatively connected to the conventional motor 28 and the conventional braking member 30 for controlling the operations thereof.

The coordinated operation of the traveling service unit 13 and the work station 3 to achieve operating alignment of the ferrite core of the antenna winding assembly 35 of the traveling service unit 13 with the antenna SP1 of the work station 3 will now be described. Once the antenna SP1 and the antenna winding assembly 35 are operatively aligned, data can be exchanged between the work station 3 and the traveling service unit 13 in a bi-directional, wireless, and relatively disbursing free manner, whereby operating instructions can be transmitted to the operating control means 32 of the work station 3 for controlling the operations thereof. In the event that the work station 3 must be serviced by one of the traveling service units, the operating control means 32 transmits a signal B1 to the oscillator T1. The signal B1 causes the oscillator T1 to produce a current having a frequency fB1 and this frequency is transmitted to the electric switch M1. The electric switch M1 includes a continuously moving switch arm which continuously alternatingly switches between an electric pole t1 at which the frequency fB1 is received and an electric pole r1 which is operatively connected by a connector 38 to the transmitter-receiver member R1. Accordingly, when the switch arm of the electric switch M1 is electrically in contact with the electric pole t1, the frequency fB1 is transmitted through the electric switch M1 and further through an electric connector 37 to the antenna member SP1. The frequency fB1 produces a magnetic field in the winding of the antenna member SP1 which is continuously extinguished and produced in coordination with the cyclic movement of the switch arm of the electric switch M1.

The service unit operating service unit control means 34 controls the traveling service unit 13 to continually travel along the textile machine 1 in opposed directions. Assuming that the traveling service unit 13 is traveling in the direction indicated by the arrow 33 as shown in FIG. 3 and that the traveling service unit 13 is offset to the right-hand side of the work station 3 as shown in FIG. 3, the operational alignment of the antenna member SP1 and the antenna winding assembly 35 proceeds as follows. The left-hand antenna winding member SP2 of the traveling service unit 13, by virtue of the movement of the traveling service unit 13 in the direction shown by the arrow 33, eventually moves into the range of the continuously changing magnetic field of the antenna member SP1. The magnetic field induces an electrical current in the antenna member SP2 which current is transmitted to the electronic positioning member P. In response to the receipt of the current from the antenna member SP2, the electric positioning member P transmits a signal VP to the service unit control means 34 of the traveling service unit 13 and continuously maintains this signal including during those periods of time in which the electric switch M1 is out of electrical connection with the electric pole t1 (i.e., the time when the magnetic field in the antenna SP1 is extinguished).

The service unit control means 34, in response to the receipt of the signal VP, controls the drive motor 28 to drive the traveling service unit 13 in the direction of the arrow 33 at a crawl speed which is relatively much less than the normal traveling speed of the traveling service unit. The continued movement of the traveling service unit 13 eventually moves the antenna member SP2 out of the range of the magnetic field produced by the antenna member SP1. However, the electronic positioning member P continues to transmit the signal VP continuously until the antenna member SP2' enters the magnetic field of the antenna member SP1.

The traveling service unit 13 continues to move at the crawl speed and eventually the antenna member SP3' enters the magnetic field of the antenna SP1 and transmits a signal to the electronic position member P. When the electronic positioning member P receives signals of substantially equal strength from the antenna members SP2' and SP3', the electronic positioning member continues to transmit the signal VP and, additionally, transmits a signal HP to the service unit control means 34. In response to the receipt of the signal HP, the service unit control means 34 de-activates the drive motor 28 and controls the brake assembly 30 to brake the movement of the traveling service unit 13. The antenna member SP4 should now be operatively aligned with the antenna SP1.

In the event that the traveling service unit 13 has been driven too far in the direction of the arrow 33, the electronic positioning member P extinguishes the signal VP while continuing to transmit the signal HP. In response to the extinguishing of the signal VP and the continued receipt of the signal HP, the service unit control means 34 controls the drive motor 28 to drive the traveling service unit 13 in the direction opposed to the direction indicated by the arrow 33 until the electronic positioning means P receives a signal from the antenna member SP2' which is of substantially equal strength to the signal received by the electronic positioning member P from the antenna member SP3'.

In the event that the traveling service unit 13 is initially traveling at its normal travel speed in the direction opposed to the direction indicated by the arrow 33, the operational alignment of the antenna member SP4 with the antenna member SP1 is accomplished as follows. As the right-hand antenna member SP3 is moved, by virtue of the traveling movement of the traveling service unit 13, into the magnetic field of the antenna member SP1, the magnetic field produces a current in the right-hand antenna member SP3 which is transmitted to the electronic positioning member P. In response to the receipt of the current from the right-hand antenna member SP3, the electronic positioning member P produces the signal VP and the service unit control means 34 responds to the signal VP to control the drive motor 28. Specifically, the service unit control means 34 controls the drive motor 28 to drive the traveling service unit 13 at a crawl speed. Eventually, the antenna member SP3' moves into the magnetic field of the antenna member SP1 and a current is produced in the antenna member SP3' by the magnetic field. The electric current from the antenna member SP3' is transmitted to the electronic positioning member P and, in response to the receipt of substantially equal strength signals from the antenna members SP2' and SP3', the electronic positioning member P transmits the signal HP to the service unit control means 34. In response to the receipt of the signal HP, the service unit control means 34 de-activates the drive motor 28 and controls the braking assembly 30 to brake the movement of the traveling service unit 13.

During the movement of the traveling service unit after the left-hand antenna member SP2 or, respectively, the right-hand antenna member SP3 has entered the magnetic field of the antenna member SP1, the electronic positioning means monitors the passage of time as the traveling service unit 13 moves at the crawl speed. If a signal from the antenna member SP2' or, respectively, the antenna member SP3' is not received within a predetermined time, the electronic positioning member P extinguishes the signals VP and HP. In response to the extinguishing of the signals VP and HP, the service unit control means 34 controls the drive motor 28 to again resume normal driving of the traveling service unit 13. The antenna members SP2' or SP3' may fail to produce the current within the predetermined time because, for example, the antenna member SP1 has ceased to emit its magnetic field due to the resumption of normal operation of the work station 3.

Once the antenna member SP4 and the antenna member SP1 have been operatively aligned with one another, the electronic positioning member P transmits a signal IP' to the oscillator T2. In response to the receipt of the signal IP', the oscillator T2 produces an electric current having frequency fB, which flows to an electric pole t2 of the electric switch M2. The electric switch M2 has a switch arm which cyclicly connects the electric pole t2 with the connector 36 leading to the antenna member SP4. The switch arm is cyclicly moved between the electric pole t2 and an electric pole r2 which is electrically connected by a connector 39 with the transmitter-receiver R2. The switch arm of the electric switch M2 is operatively connected by a connector, schematically shown as a connector m, to the electronic positioning member P. The electronic positioning member P controls the switch arm of the electric switch M2 to electrically connect the electric pole t2 with the connector 36 and alternately to electrically connect the electric pole r2 with the connector 36 in such a manner that the switch arm is electrically connected to the electric pole t2 when the magnetic field is being produced in the antenna member SP1 and to electrically connect the electric pole r2 with the connector 36 when the magnetic field in the antenna member SP1 is absent (i.e., when the switch arm of the electric switch M1 is electrically connected to the electric pole r1).

When the antenna members SP4 and SP1 are operatively aligned as a result of the above-described aligning sequence, the two antenna members are spaced from one another within the range of a few millimeters. Each time the switch arm of the electric switch M2 is electrically connected to the electric pole t2, the electric currency having the frequency fB flows from the oscillator T2, through the electric switch M2, the electric connector 36, the antenna member SP4. The electric current then continues to flow from the antenna member SP4 to the antenna member SP1, through the connector 37 to the electric switch M1 and through the electric switch M1 and the connector 38 to the transmitter-receiver R1. In response to the receipt of the current having the frequency fB, the transmitter-receiver R1 transmits a signal IP to the operating control means 32 of the work station 3 and the control means 32 interprets the signal as an indication that the traveling service unit is in a service position for servicing the work station 3 and that a data exchange can now be executed between the work station 3 and the traveling service unit 32.

The data exchange between the work station 3 and the traveling service unit 13 operates as follows. The operating control means 32 of the work station 3 cyclicly transmits a signal S1 and the cycle of the signal S1 corresponds to the units of data being transmitted by the operating control means 32. The cycle of the signal S1 is relatively slower than the cycling movement of the switch arm of the electric switch M1. The signal S1 is transmitted from the operating control means 32 to the oscillator T1 and, in response to this signal, the oscillator T1 changes the frequency of the current transmitted to the electric switch from fB1 to fS1. Accordingly, the antenna member SP1 transmits a frequency signal which is determined by the interval between the frequency fB1 and the frequency fS1. The frequency signal is transmitted from the antenna member SP1 through the antenna member SP4 of the traveling service unit 13, through the electric switch member M2 and the connector 39 to the transmitter-receiver R2. In response to the receipt of the frequency signal, the transmitter-receiver R2 cyclicly transmits a signal E2 to the service unit control means 34. Accordingly, the signal E2 is transmitted in correspondence with the transmission of the signal S1 and the units of data are thus transmitted from the operating control means 32 of the work station 3 to the service unit control means 34 of the traveling service unit 13.

The service unit control means 34 transmits data to the work station 3 as follows. The service unit control means 34 transmits a signal S2 to the oscillator T2 in correspondence with the units of data. In response to the signal S2, the oscillator T2 oscillates the current transmitted to the electric switch M2 between the frequency fB and the frequency fS2. The interval between the frequency fB and the frequency fS2 is transmitted in the form of a frequency signal from the antenna member SP4 to the antenna member SP1 and is sequentially transmitted through the connector 37, the electric switch member M1 and the connector 38 to the transmitter-receiver R1. In response to the frequency signal, the transmitter-receiver R1 transmits a signal E1 to the operating control means 32. Accordingly, data is transmitted from the service unit control means 34 of the traveling service unit 13 to the operating control means 32 of the work station 3. The type of data transmitted between the operating control means 32 and the service unit control means 34 can be, for example, data relating to the activation and de-activation of certain moving components of the work station 3 so that the traveling service unit 13 can execute a service operation at the work station 3.

Upon the completion of the servicing of the work station 3 by the traveling service unit 13, the operating control means 32 extinguishes the signal B1. In response to the extinguishing of the signal B1, the electronic positioning member P extinguishes the signals VP and HP and the service unit control means 34 responds to the extinguishing of the signals VP and HP by controlling the braking assembly 30 to cease its braking operation and controlling the drive motor 28 to again drive the traveling service unit 13 along the textile machine 1.

Each of the work stations 2 and 4–12 are provided with the data exchange coordinating apparatus explained with respect to the work station 3.

To request servicing by the traveling service unit 14, the work station 3 is provided with an antenna member SP1'. The antenna member SP1' is positioned vertically below the antenna member SP1 and transmits a signal of a different frequency than the frequency fB1 transmitted by the antenna member SP1. As shown in FIG. 2, the positioning of the antenna member SP1' vertically below the antenna member SP is coordinated with the positioning of the signal apparatus 27' on a traveling service unit 14. Specifically, the signal apparatus 27' is positioned on the traveling service unit 14 at a vertical location lower than the location of the signal apparatus 26' on the traveling service unit 13.

However, the electronic positioning member P of the signal apparatus 27' is adjusted to respond to electronic current of different frequency than the electronic positioning member P of the traveling service unit 26'. As can be understood, additional antenna members can be provided at the work stations 2–12 to respectively request the services of additional traveling service units.

During the data exchange between the traveling service unit 13 or 14 and their respective one of the work stations 2–12 to be serviced by the traveling service unit, data is initially transferred from the service unit control means 34 of the traveling service unit to the respective work station. The initially transferred data prompts the operating control means 32 of the respective work station to activate appropriate braking components which brake the rotation of the cross-wound package being built at the work station and to de-activate the yarn delivery components of the work station. Following the initial transmission of data from the service unit control means 34 to the operating control means 32, the operating control means 32 transmits data to the service unit control means 34 which indicates the success or non-success of the work station in stopping the rotation of the cross-wound package and/or ceasing the operation of the yarn delivery components. The traveling service unit 14, which follows the traveling service unit 13 to again set the respective work station into winding operation following the service operation by the traveling service unit 13, may be unable to execute its operation. In the event, for example, of sliver breakage, the traveling service unit 13 can be programmed to execute a servicing operation in which a cleaning operation is performed at the respective work station. For example, in conventional manner, a gripping arm (not shown) of the traveling service unit 13 can be activated to open the spin box of the respective work station, another conventional arm can be activated to drive the opening roller at a relatively low rate of speed and to direct blasts of cleaning fluid, such as air, to clean the spinning box.

During a cleaning operation such as described above, the service unit control means 34 can transmit data to the operating control means 32 to cause a disturbance signal to be illuminated at the respective work station which can alert servicing personnel to service the respective illuminated work station. Additionally, the operating control means 32 can be supplied with data indicating that no further traveling service unit should be requested at the respective work station until the disturbance thereat has been taken care of by the servicing personnel. In this event, the service unit control means 34 can transmit data to the operating control means 32 to cause, for example, the antenna members SP1 and SP1' to be de-activated and/or to interrupt the transmission capability of the connector 37.

In the event that the respective work station successfully stops the rotation of the cross-wound package being built thereat and puts the yarn delivery components out of operation, the service unit control means 34 controls the drive motor 28 of the traveling service unit 13 to drive the traveling service unit 13 to a further work station requiring servicing following the execution of the servicing operation at the respective work station.

As seen in FIG. 4, each of the work stations 2–12 can alternatively be provided with a single adjustable antenna member SP1 in lieu of a plurality of individual antenna members SP1,SP1' and other individual antenna members. The adjustable antenna member SP1 includes a core formed of iron or ferrite having a rounded pole shoe 41. Each of the traveling service units 13,14 as well as an additional traveling service unit (not shown) is provided with an individual antenna member SP4,SP4' and SP4", respectively The antenna members SP4,SP4' and SP4" are located on their respective traveling service units such that each has a unique orientation with respect to the adjustable antenna member SP1. Accordingly, the traveling service units can be driven past one another and their respective antenna members SP4,SP4' or SP4" can be positioned at a spacing from the pole shoe 41 of the adjustable antenna member SP1 to a maximum spacing of approximately two centimeters.

The oscillator T1, the transmitter-receiver R1, the switch member M1, the oscillator T2, the transmitter-receiver R2, the switch member M2, the electronic positioning member P and the various antenna members can be formed of appropriate conventional components such as, for example, integrated circuit components.

Figure 6:
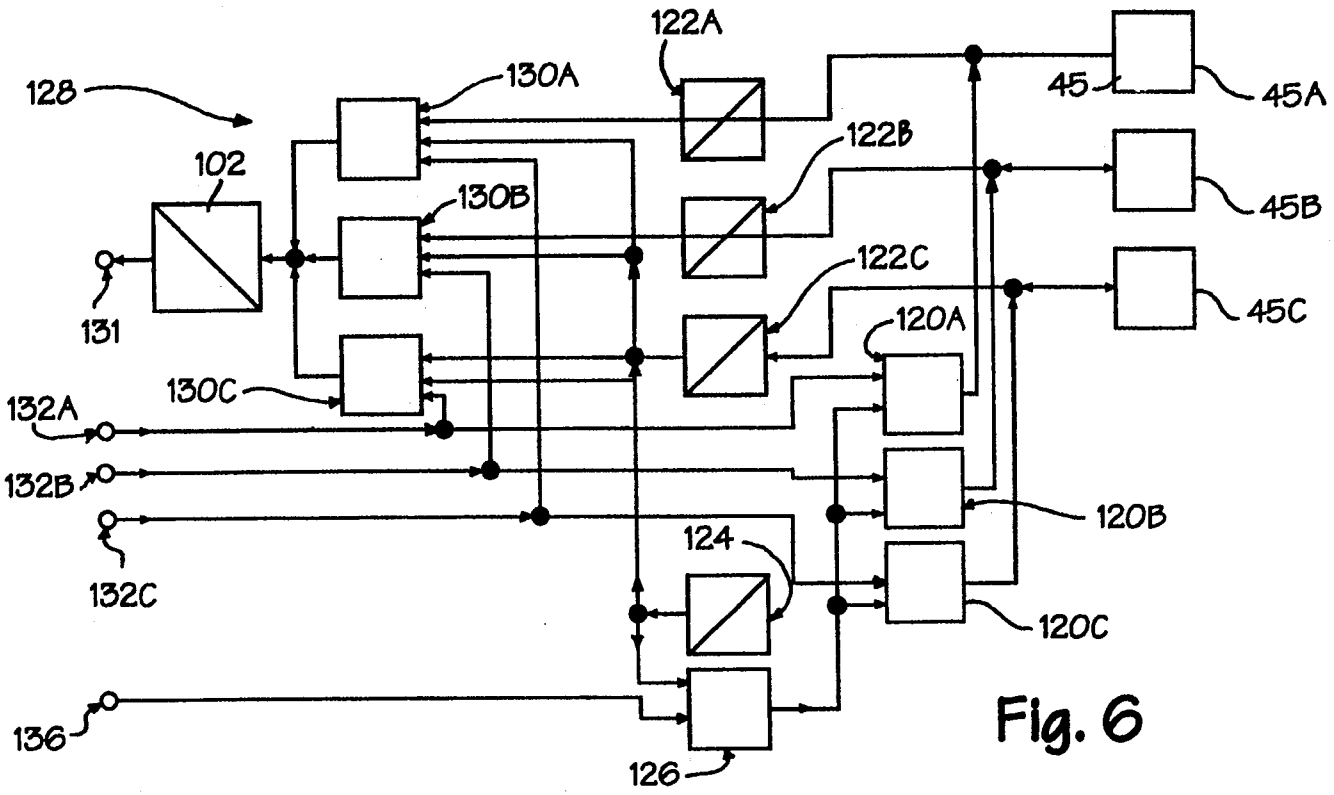
FIG. 6 is a schematic representation of the portion of the another embodiment of the data exchange coordinating apparatus shown in FIG. 5 which is mounted to the work station of the textile machine.

In FIG. 5, another embodiment of the data exchange coordinating apparatus of the present invention is illustrated. Each of the work stations 2–12 is provided with a production side electronic assembly 128 and one of the traveling service units 13,14 is provided with an electronic assembly 140. As illustrated in FIG. 6, the production side electronic assembly 128 includes a conventional oscillator 124 which produces right angled oscillations of a frequency of about twenty-five kilohertz which serves as a base oscillation for all operations of the production side electronic assembly 128. The oscillator 124 is operatively connected to a conventional pulse with modulation member 126 and produces a signal in the pulse with the modulator member 126 having length of approximately seven seconds. The production side electronic assembly 128 produces various request signals for requesting certain types of servicing of the respective work station. For example, as seen in FIGS. 5 and 6, a request 132A is schematically shown to indicate a request for a traveling service unit which can set the respective work station into further winding operation. Likewise, a request 132B is schematically illustrated in FIGS. 5 and 6 and represents a request for a traveling service unit to perform a package exchange operation at the respective work station.

As seen in FIG. 6, a respective request signal 132A,132B or 132C is produced according to the particular servicing requirement of the respective work station and is directed to a respective one of a plurality of conventional exciters 120A,120B or 120C, respectively. Each of the exciters 120A,120B,120C are individually connected to the pulse with modulator member 126 and is individually connected to a conventional antenna winding 45A,45B or 45C, respectively. Accordingly, each request signal 132A,132B and 132C is transmitted via its respective exciter 120A,120B or 120C to the antenna windings 45A,45B or 45C, respectively, in response to the signal produced by the pulse with modulator member 126.

Each of the antenna windings 45A,45B and 45C are wound on a rod antenna 46 having a ferrite core. The antenna windings 45A,45B and 45C are appropriately spaced from one another to foreclose the possibility that a traveling service unit not of the type requested answers the request signal.

Figure 7:
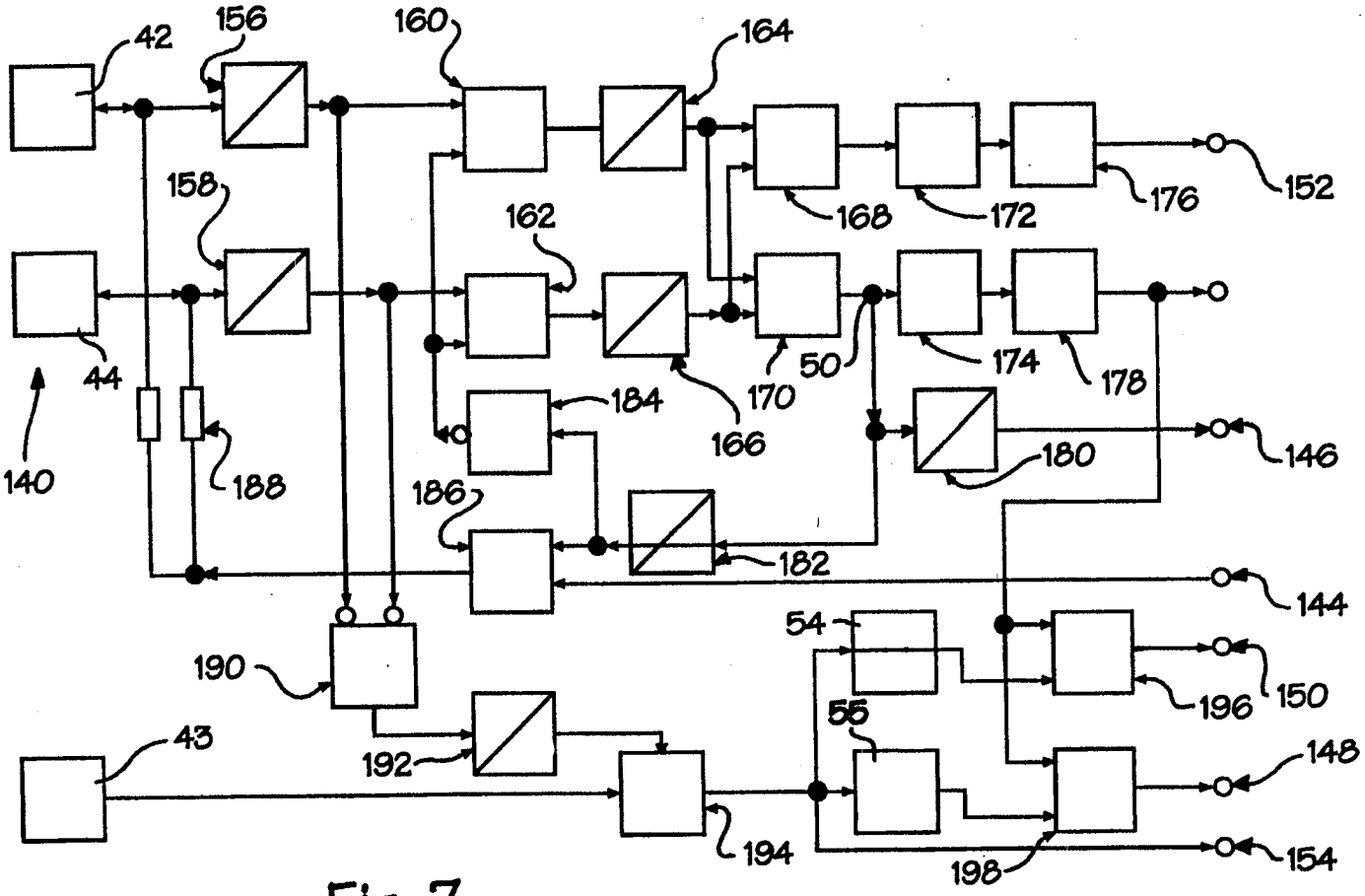
FIG. 7 is a schematic representation of the portion of the another embodiment of the data exchange coordinating apparatus shown in FIG. 5 which is mounted on the traveling service unit.

As illustrated in FIGS. 5 and 7, each traveling service unit 13,14 includes an electronic assembly 140. The electronic assembly 140 includes an antenna assembly 141 having a pair of rod antenna windings 42,44 and a middle antenna winding 43. As shown in FIG. 8, the rod antenna windings 42,44 and the middle antenna winding 43 are wound on a rod antenna 47 having a ferrite core. The rod antennas 46 are each oriented at substantially a right angle to the rod antenna 47.

As shown in the preferred embodiment of FIG. 8, the length l1 of the rod antenna 46 is approximately twenty-five millimeters and the diameter of the one of the rod antenna 46 is approximately ten millimeters. The length 12 of the rod antenna 47 is approximately ninety millimeters and the diameter d2 of the rod antenna 47 is approximately ten millimeters. The rod antenna windings 42,44 of the rod antenna 47 and the antenna winding 45 of the rod antenna 46 each have a length 13 of approximately ten millimeters. The rod antenna winding 43 of the rod antenna 47 has a length 14 of approximately fifty-two millimeters. The production side electronic assembly rod antenna 46 and the service unit rod antenna 47 is approximately ten millimeters and the maximum spacing is approximately twenty millimeters. The receipt of the request signal by the traveling service unit occurs when the most closely adjacent winding 42 or 44 of the rod antenna 47 is in the range of approximately ten to seventy millimeters before the center position of the work station. Transmission departure signal occurs in a range of approximately zero-twenty millimeters on each side of the center of the work station. The tolerance range for the centered alignment of the traveling service unit and the work station is in the range of approximately plus or minus three millimeters. The minimum distance between the metal housing components of the ferrite core should be five millimeters. The minimum spacing between each adjacent pair of request antennas 45A,45B or 45C is approximately sixty millimeters.

As seen in FIG. 5, the respective antenna winding 45A,45B or 45C transmits the respective request signal 132A,132B or 132C to be received by the antenna assembly 141. Specifically, as seen in FIG. 8, the respective request signal is transmitted by the respective rod antenna 46 and is received by the rod antenna 47 of the traveling service unit. The request signal transmitted by the respective rod antenna 46 is transmitted in the form of a wave having a square-shaped amplitude, as illustrated in FIG. 9*a*. The antenna windings 43,44 of the rod antenna 47 receive the signal from the respective rod antenna 46 and transform the signal into wave form illustrated in FIG. 9*b*. As illustrated in FIG. 7, a conventional Schmitt trigger member 156 is operatively connected to the antenna winding 42 and a conventional Schmitt trigger member 158 is operatively connected to the antenna winding 44. The Schmitt trigger member 156,158 transforms the signal from the respective one of the antenna windings 42,44 which receives the signal from the rod antenna 46 into a wave having a square-shaped amplitude as illustrated in FIG. 9*c* and limits the period to about five microseconds. This setting of the wave form limits the influences of disturbance impulses of relatively long duration. The wave form illustrated in FIG. 9*b* results from the inductivity of the antenna windings 45A,45B and 45C.

The Schmitt trigger member 156 is operatively connected to a conventional end coupler 160 and the Schmitt trigger member 158 is operatively connected to a conventional end coupler 162. The end coupler member 160 is operatively connected to a conventional pulse length limiter 164 and the end coupler member 162 is operatively connected to a conventional pulse length limiter 166. Each pulse length limiter 164,166 is operatively connected to an OR coupler member 168 and an AND coupler member 170. The OR coupler 168 is operatively connected to a low pass filter 172 and the AND coupler 170 is operatively connected to a low pass filter 174. The low pass filters 172,174 are connected to a threshold value switch 176,178, respectively.

The AND coupler 170 is connected by a connector 50 to a pulse length recognition member 180 and a transmit time indicator 182. The transmit time indicator 182 is operatively connected to a conventional invertor 184 and the invertor 184 is operatively connected to the AND coupler 162. The transmit time indicator 182 is also operatively connected to a drive gate 186 and the drive gate 186 is operatively connected to a load 188 and the load 188 is operatively connected to the Schmitt triggers 156 and 158.

The Schmitt trigger members 156,158 are operatively connected to an OR coupler 190 and the OR coupler 190 is operatively connected to a conventional needle former 192. The needle former 192 is operatively connected to a conventional in-phase rectifier having a sample hold step capacity. The middle antenna winding 43 is also operatively connected to the in-phase rectifier 194. A pair of threshold value switch members 54,55 are operatively connected to the in-phase rectifier 194. The threshold value switch member 54 is operatively connected to an AND coupler 196 which is, in turn, operatively connected to the left-hand position indicator 150. The threshold value switch member 55 is operatively connected to an AND coupler 198 which is, in turn, operatively connected to the right-hand position indicator 148. The threshold value switch members 54,55 are operatively connected to the analog departure indicator 154. The pair of AND couplers 196,198 are operatively connected to the threshold value switch member 178.

The production side electronic assembly 128 additionally includes a plurality of signal preparation members 122A,122B and 122C operatively connected to the antenna windings 45A,45B and 45C, respectively, and to a plurality of AND couplers 130A,130B and 130C, respectively. The AND couplers 130A,130B,130C are operatively connected to the request signal members 132C,132B and 132A, respectively. Additionally, the AND couplers 130A,130B,130C are operatively connected to an impulse recognition step member 102 which is, in turn, operatively connected to an output data indicator 134. The AND couplers 130A,130B,130C are operatively connected to the oscillator 124 and to the pulse with modulator member 126.

The production side electronic assembly 128 and the traveling service unit electronic assembly 140 cooperatively operate together in the following manner to exchange data between the traveling service unit and the respective work station. As seen in FIG. 6, the production side electronic assembly 128 generates a particular request for servicing by one of the traveling service units in that one of the request signal members 132A,132B or 132, each of which is configured to produce a request signal corresponding to a particular request, generates a request signal. For example, the request signal member 132A can generate a request signal requesting that a traveling service unit prepare the respective work station for another spinning operation or the request signal member 132B can generate a request signal requesting that a traveling service unit perform a package exchange operation at the respective work station. The selected request signal is handled by the associated drive step member 120A,120B or 120C and is further transmitted to the associated antenna winding 45A,45B or 45C. As seen in FIG. 5, the antenna windings 45A,45B and 45C are disposed outwardly of the respective work station so that the service unit electronic assembly 140 of a traveling service unit passing by the respective work station passes within a relatively limited distance of the antenna windings 45A,45B and 45C.

As seen in FIG. 7, as a traveling service unit approaches the respective work station from which a request signal is being broadcast from the respective one of its antenna windings 45A,45B or 45C, the broadcast signal is received by the rod antenna windings 42,43 and 44. The rod antenna windings 42 and 44 receive the request signal broadcast by the rod antenna 46 in the form shown in the graph in FIG. 9*a* and convert the signal into the form shown in the graph in FIG. 9*b*. The Schmitt triggers 156,158 transform the signals received by the rod antenna windings 42,44 into the signal form shown in the graph in FIG. 9*c* and limits the phase length of each impulse of the request signal to approximately five microseconds. This limiting action serves to minimize the influence of disturbance impulses of relatively long duration. The signal form illustrated in the graph in FIG. 9*b* is representative of the signal form which occurs due to the inductivity of the antenna windings 45A,45B and 45C.

The time-limited impulses from the Schmitt triggers 156,158 are transmitted through the associated And coupler 160 and the pulse length limiter 164 and the AND coupler 162 and the pulse length limiter 166, respectively, and are further transmitted through the OR coupler 168 to the low pass filter 172. The low pass filter 172 transforms the impulse into an average value and transmits the impulses further to the threshold value switch member 176 to a predetermined threshold voltage, thereby activating the service unit request signal indicator 152. The activation of the service unit request signal indicator 152 prompts the control means of the respective traveling service unit to reduce the normal traveling speed of the traveling service unit to a relatively lower positioning speed. Accordingly, the traveling service unit continues to move toward an alignment position with the respective work station broadcasting the request signal and, when the traveling service unit has approached to within a range of approximately twenty-five millimeters of the center position of the respective work station, the magnetic field broadcast by the respective work station causes an in-phase signal to be received in the rod antenna windings 42,44. This in-phase signal is illustrated in FIG. 10. Specifically, the rod antenna winding 42 receives a signal having the form indicated by the plot 48 and the rod antenna winding 44 receives a signal in the form indicated by the plot 49. The region in which the plots 48,49 overlap one another is the in-phase region and is designated as q in FIG. 10.

The in-phase relation of the signals received by the rod antenna windings 42,44 is illustrated in FIG. 7 as an impulse voltage which passes through AND coupler 170 and the connector 50 to the low pass filter 174. The low pass filter 174 further transmits the impulse voltage to the threshold value switch member 178 which generates an internal signal for transmission to the control means of the traveling service unit which indicates to the control means that the traveling service unit has entered a predetermined limited range with respect to the work station to be serviced.

The signal induced in the rod antenna winding 43 corresponds to the amplitude and phase relation of the relative position of the traveling service unit and the work station to be serviced. As shown in FIG. 11, the signal received by the rod antenna windings 42,44 are in the form illustrated in the graph in FIG. 11*a*. Based upon the declining curvature of the signal form illustrated in the graph in FIG. 11*a*, a needle impulse 51, shown in FIG. 11*b*, is produced. The needle impulse 51 influences, for a relatively short time, the input signal of the rod antenna winding 43 to be transformed by a capacitor associated with the in-phase rectifier 194, as illustrated in the graph in FIG. 11*c*. Accordingly, a direct current voltage 52 corresponding to the right-hand position of the traveling service unit with respect to the work station to be serviced and a direct current voltage 53 corresponding to the left-hand position of the traveling service unit relative to the work station to be serviced occur at the capacitor.

Figure 12:
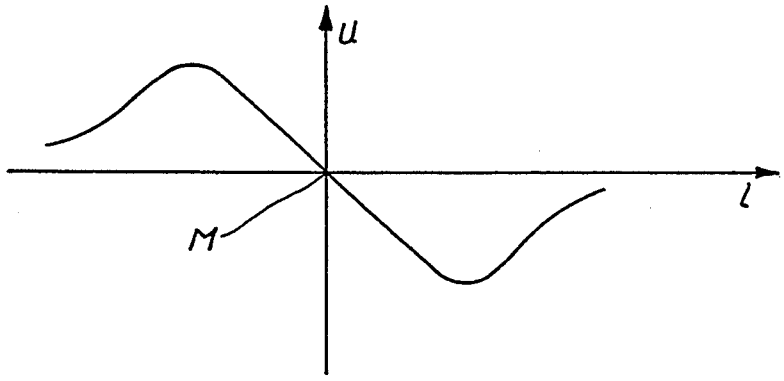
FIG. 12 is a graphic representation of the intersection of the left and right-hand position signals of the data exchange coordinating apparatus of the present invention.

The threshold value switch members 54,55 produce an analog value corresponding to the relative right and left-hand displacement of the traveling service unit with respect to the center of the work station to be serviced. The respective analog values are transmitted to the control means of the traveling service unit in the form of the left position signal 150 and the right position signal 148. The control means of the traveling service unit responds to the left position signal 150 and the right position signal 148 to control the movement of the traveling service unit to center the traveling service unit with respect to the work station to be serviced. As illustrated in FIG. 12, when the left position signal 150 and the right position signal 148 enter at a middle position M in which both signals are active, the control means of the traveling service unit de-activates the drive motor of the traveling service unit to preclude further traveling movement of the service unit. If an analog control of the positioning of the traveling service unit with respect to the work station is to be used, the analog voltage can serve as the actual value.

The analog signal is available once the traveling service unit moves within the range of approximately twenty millimeters distance, as measured in the direction of travel of the traveling service unit, from the center position of the work station.

Figure 13A:
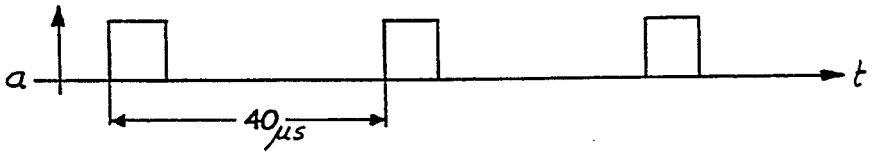
FIG. 13 is a graphic representation of the data exchange signals of the data exchange coordinating apparatus of the present invention.
Figure 13B:
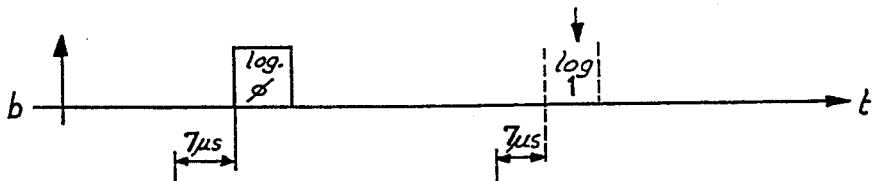
Figure 13C:
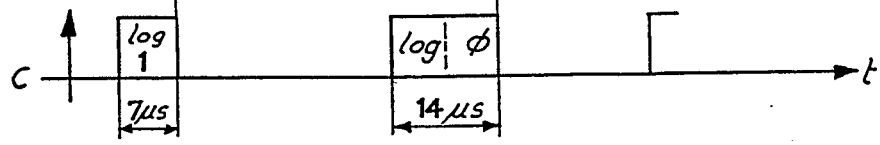

Once the traveling service unit has been substantially aligned with the respective work station to be serviced, data is exchanged between the traveling service unit and the work station as follows. As seen in FIG. 13, the production side electronic assembly 128 continues to transmit its request signal so long as the work station requires servicing and the signal form is indicated by the graph illustrated in FIG. 13*a*. Specifically, the signal form has a period of approximately forty microseconds which corresponds to about twenty-five kilohertz. In the interval between each adjacent pair of impulses, data can be transmitted from the traveling service unit to the work station. Specifically, as shown in the graph in FIG. 13*b*, data to be transmitted from the traveling service unit is transmitted in the form of data impulses, each data impulse being transmitted during the interval between an adjacent pair of impulses of the request signal from the work station. Each data impulse accordingly begins approximately seven microseconds following the back side of the immediately preceding impulse of the request signal, as illustrated in the graph in FIG. 13*c*. The existence of a data impulse between an adjacent pair of impulses of the request signal is represented as logarithm 0 while the absence of a data impulse is represented by the logarithm 1. This process of transmitting data via data impulses offers two advantages. First, the frequency of the impulses of the request signal can be adjusted through a relatively wide range, whereby the frequency is not critical, and, secondly, the electronic components of the traveling service unit for receiving the request signal do not require any special synchronization to receive a specific request signal frequency.

Through this data exchange process, the traveling service unit can notify the production side electronic assembly 128 that the traveling service unit is positioned in the service position, whereby no special signal is required to impart this information to the work station.

In the event that the traveling service unit does not have any data to transmit to the work station, the control means of the traveling service unit immediately switches the data input 144 to logarithm 0 as an indication that the traveling service unit is in position for servicing the work station.

The production side electronic assembly 128 is configured to interpret the absence of any logarithm 0 impulses at the production side data output 134 as an indication that a voltage drop or other disturbance has occurred at the traveling service unit.

Data can also be transmitted from the work station to the traveling service unit through transformation of the length of the impulses of the request signal. For example, a normal length impulse of seven microseconds can be evaluated by the control means of the traveling service unit as logarithm 1 while, as shown in FIG. 13*c*, an impulse of fourteen microseconds (i.e., twice the length of a normal impulse) can be evaluated as logarithm 0 by the control means of the traveling service unit.

The exchange of data between the traveling service unit and the respective work station can be conducted at a rate of approximately three hundred Baud in which approximately eighty individual units of information for each bite is integrated through a low pass filter. A threshold value switch member having hysteris capability transforms the signal transmitted by the low pass filter into binary information. In this manner, the occurrence of disturbance signals can be suppressed so that a fully reliable full-duplex-data exchange can be accomplished.

Following the completion of the servicing of the work station by the traveling service unit, the production side electronic assembly 128 ceases the transmission of the request signal and, in response thereto, the service unit signal 152, the left position signal 150 and the right position signal 148 cease. The control means of the traveling service unit responds to the extinguishing of the service unit request signal 152, the left position signal 150 and the right position signal 148 by controlling the drive motor of the traveling service unit to again drive the traveling service unit at its normal traveling speed.

Figure 14:
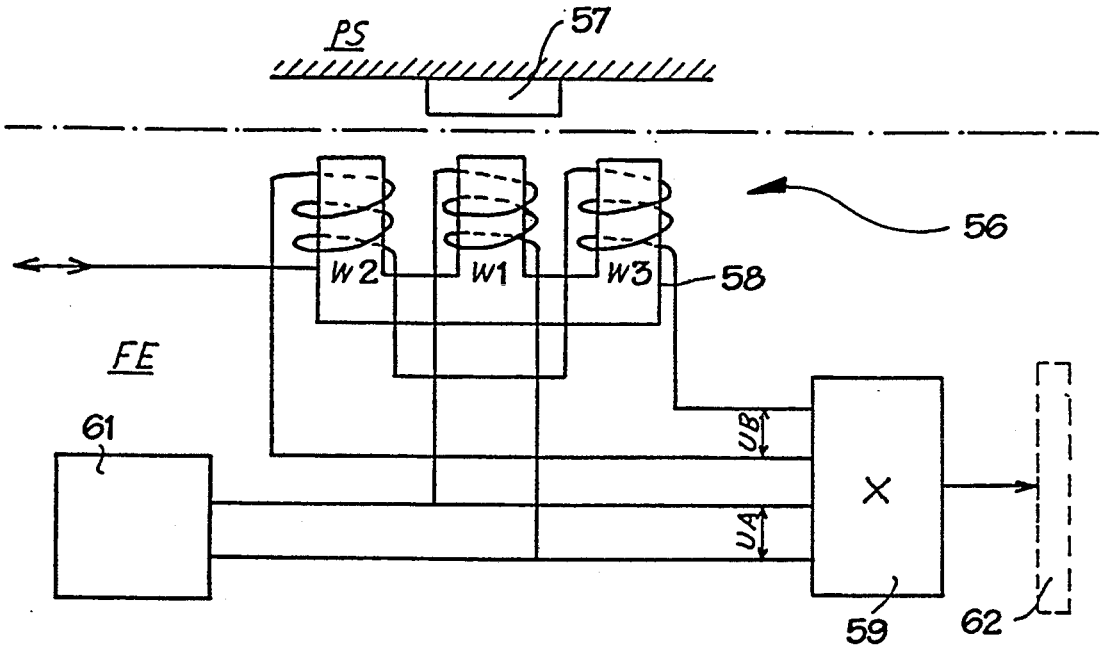
FIG. 14 is a schematic representation of another form of the antenna means of the data exchange coordinating apparatus of the present invention.

In FIG. 14, another form of an antenna assembly on a work station and an antenna assembly on a traveling service unit for aligning the traveling service unit at the work station is illustrated. A work station PS is provided with a ferrous plate 57 having a surface area of approximately twenty x twenty millimeters. A traveling service unit FE is provided with an E-shaped core 58 having three parallel extensions. An antenna winding W1 is wound on one of the parallel extensions of the core 58 and is operatively connected to a conventional oscillator 61. An antenna winding W2 is wound around another of the parallel extensions of the core 58 and is operatively connected to a multiplier 59. An antenna winding W3 is wound around the third of the parallel extensions of the core 58 and is operatively connected to the multiplier 59 and the antenna winding W2. The multiplier 59 is operatively connected to a position control means 62 of the traveling service unit FE.

Figure 15:
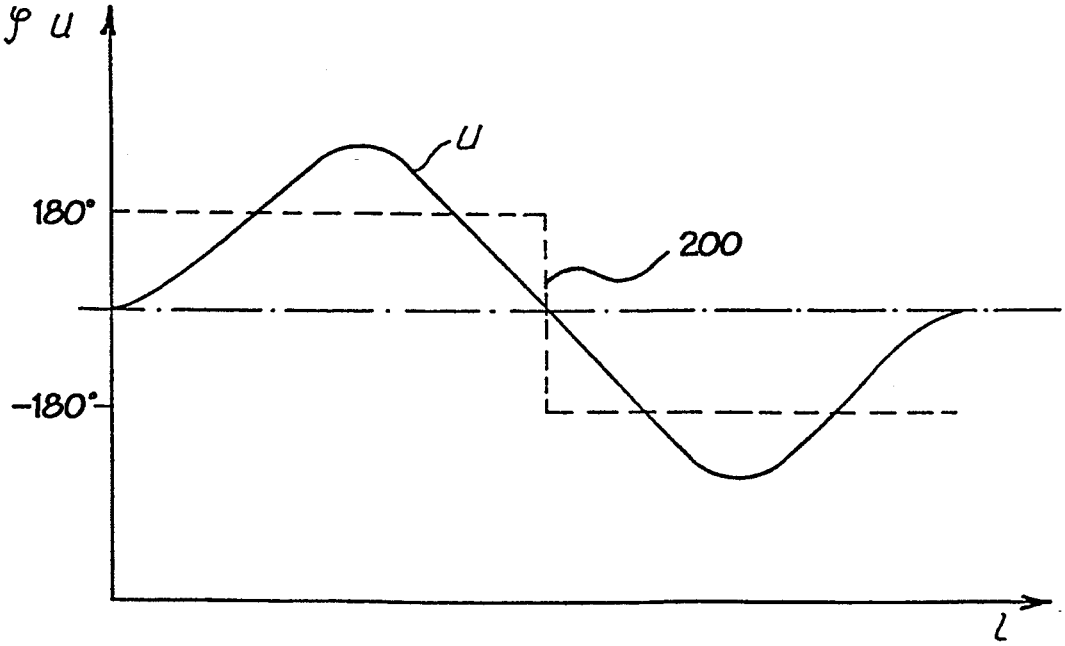
FIG. 15 is a graphic representation of the characteristics of the electrical current produced by the antenna means shown in FIG. 14.

The oscillator 61 produces a variable voltage preferably in the range of ten kilohertz to one hundred kilohertz, in the antenna winding W1. In response to the variable voltage created in the antenna winding W1, voltages are induced in the antenna windings W2,W3 and these voltages are 180 degrees out of phase with one another so that a resulting voltage UB having a value of zero volts is produced. As the traveling service unit FE approaches the work station PS, the ferrous plate 57 influences the induction characteristics of the antenna windings W2,W3 and, accordingly, alters the normal 180 degrees out of phase relation between the voltage induced in the antenna winding W2 and the voltage induced in the antenna winding W3. Specifically, as illustrated in FIG. 15, the plot 200 represents the normal 180 degrees out of phase relation of the induced voltage in the antenna windings W2,W3. The plot U represents the resulting voltage which occurs due to the influence of the ferrous plate 57 on the antenna windings W2,W3. The voltage UB is multiplied by the multiplier 59 into an oscillator voltage UA having an end phase characteristic. The voltage U can be evaluated as an actual value by the control means 62 for controlling the alignment of the traveling service unit FE with respect to the work station PS.

Figure 16:
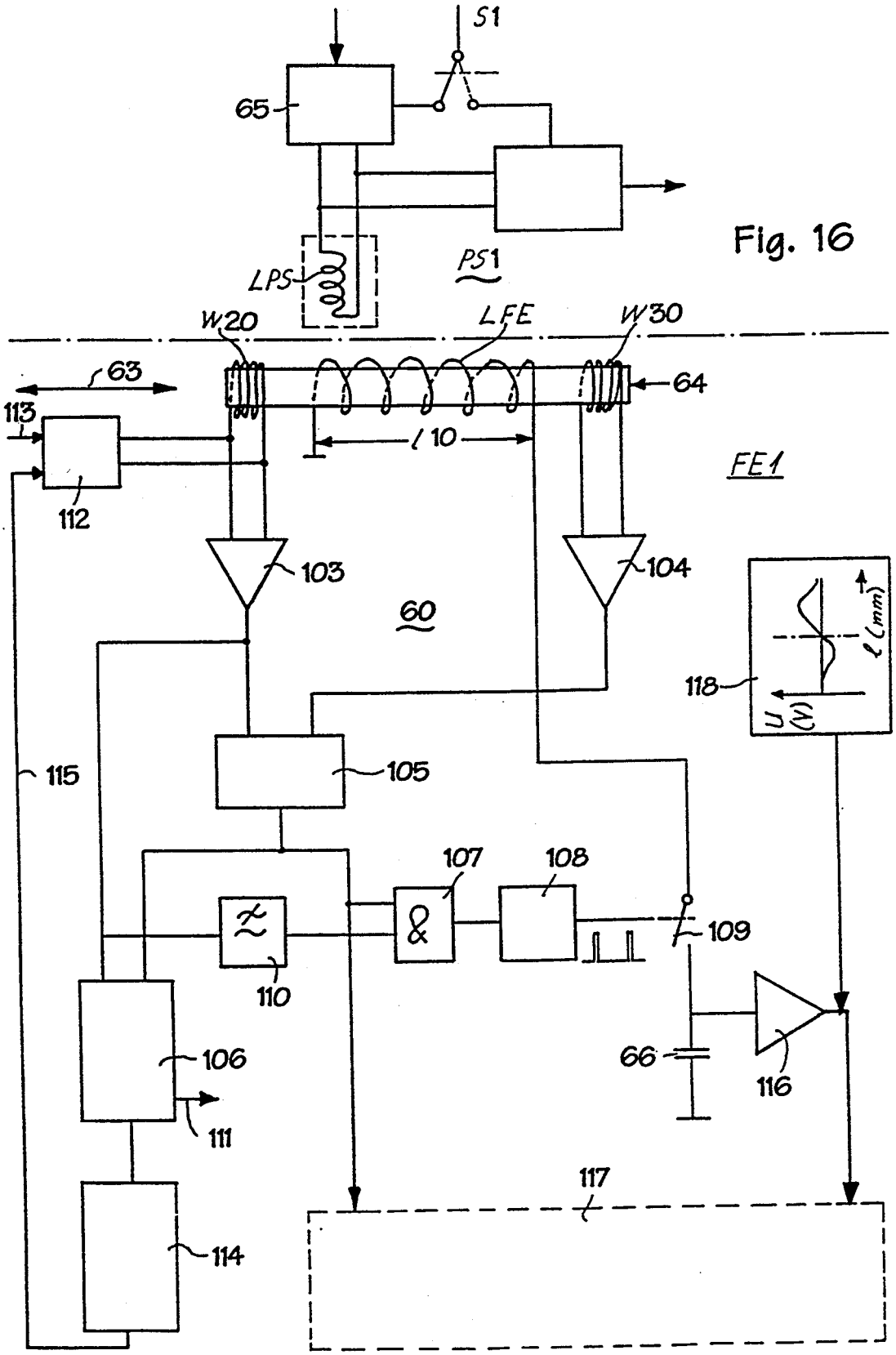
FIG. 16 is a schematic representation of a further embodiment of the data exchange coordinating apparatus of the present invention.

Another apparatus for positioning a traveling service unit FE1 with respect to a work station PS1 is illustrated in FIG. 16. The data exchange coordinating apparatus 60 includes a rod-shaped core 64 and an antenna winding LFE wound on the core 64. The antenna winding LFE has a length 110 of approximately fifty-two millimeters. The data exchange coordinating apparatus 60 additionally includes an antenna winding LPS operatively coupled to a transmitter 65 of the work station PS1. A conventional switch S1 is operatively connected to the transmitter 65.

The data exchange coordinating apparatus 60 further includes a pair of antenna windings W20,W30, each wound on a respective end of the core 64. The antenna winding LFE is disposed on the traveling service unit FE1 and is oriented approximately 90 degrees with respect to the antenna winding LPS. The core 64 is axially aligned with the direction of travel 63 of the traveling service unit FE1. The antenna winding W20 is operatively connected to an amplifier 103 and the antenna winding W30 is operatively connected to an amplifier 104. The amplifiers 103,104 are operatively connected to a conventional recognition apparatus 105, and the amplifier 103 and the recognition apparatus 105 are operatively connected to a conventional receiver 106 having a data output 111. The receiver 106 is operatively connected to a transfer recognition component 114 which is, in turn, connected by a connector 115 with a transmitter 112 having a data output 113. The transmitter 112 is operatively connected to the antenna winding W20. The antenna winding LFE is operatively connected to a conventional switch 109 which selectively connects the antenna winding with a conventional condenser 66. The condenser 66 is operatively connected to an amplifier 116 which is, in turn, operatively connected to a position control assembly 117. The recognition component 105 is operatively connected to a conventional AND member 107 and a monostable multivibrator 108. The AND component 107 and the monostable multivibrator 108 are operatively connected to the switch 109 for controlling the switch to selectively interconnect the antenna winding LFE and the condenser 66. The diagram 118 schematically represents the analog signal transmitted by the condenser 66 through the amplifier 116 to the position control assembly 117.

When the work station PS1 requires servicing by a traveling service unit, the transmitter 65 is controlled by the operating control means of the work station to conduct a variable current through the antenna winding LPS. Accordingly, when the traveling service unit FE1 approaches the work station PS1 during its normal travel, the core 64 enters into the broadcast field produced by the antenna winding LPS and, in response thereto, a voltage is induced in the antenna winding LFE. As the traveling service unit FE1 moves closer to a centered position with respect to the work station PS1, the voltage induced in the antenna winding LFE correspondingly diminishes from a maximum value to 0, the voltage value being 0 when the traveling service unit is centrally aligned with the work station PS1 (i.e., when the antenna winding LPS is aligned with the point of the core 64 if the traveling service unit FE1 continues to move past the center position with respect to the work station PS1 the phase of the voltage induced in the antenna winding LFE reverses direction. Accordingly, one can approximately center the traveling service unit FE1 with respect to the work station PS1 through the use of an in phase rectifier.

If an in phase rectifier is to be used, a variable voltage with a predetermined phase length is provided. Because the output voltage of the antenna winding LFE experiences a phase angle shift, the output voltage cannot be used for the production of the necessary variable voltage for the in phase rectifier. Accordingly, another circuit must be used to provide an in phase signal. In this respect, the antenna windings W20,W30, have voltages induced therein by the antenna winding LPS and these voltages are transmitted to the respective associated amplifiers 103,104 and, further, to the recognition component 105. The output voltages from the antenna windings W20,W30 have the same phase positions when the core 64 is approximately centered with respect to the antenna winding LPS (more specifically, when the antenna winding LPS is aligned with the extent of the core 64 comprising the middle 80% of its length).

The voltage signals from the antenna windings W20,W30 are conducted to the receiver 106 and evaluated as an indication that the traveling service unit FE1 has arrived within a predetermined spacing range with respect to the center of the work station PS1.

Data can be exchanged between the traveling service unit FE1 and the work station PS1 as follows. If data is to be transmitted from the traveling service unit FE1 to the work station PS1, the variable voltage in the antenna winding LPS is de-activated so that the antenna winding can serve as a receiving antenna. It is advantageous if, during this time, the switch S1 switches the transmitter 65 to a data receiving switch member since, at this time, the positioning signal is absent and the relative positioning of the traveling service unit FE1 with respect to the work station PS1 would be adversely influenced. It is not possible to switch the transmitter 65 into a data receiving switch member at the time in which the traveling service unit FE1 initially reaches the center position with respect to the work station PS1. Data from the traveling service unit FE1 is then transmitted to the antenna winding LPS of the work station PS1.

During the data exchange, the receiver 106 receives the voltage impulses from the amplifier 103 and the recognition component 105 and further transmits the impulses to the transfer recognition component 114. The transfer recognition component 114 monitors the periods of time during which the receiver 106 receives impulses and, via the connector 115, activates the transmitter 112 to transmit data impulses during those periods of time in which no data impulses are being received by the receiver 106.

The condenser 66 controls the position control means 117 via the amplifier 116. The condenser 66 transmits an analog signal having the form illustrated in the diagram 118. The recognition component 105 selectively controls the position control means 117 directly.

Figure 18A:
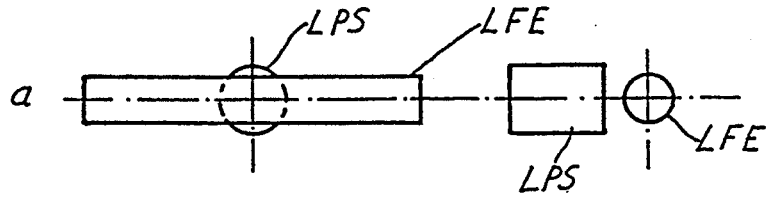
FIG. 18 is a schematic representation of several forms of the antenna means of the further embodiment of the data exchange coordinating apparatus shown in FIG. 16.
Figure 18B:
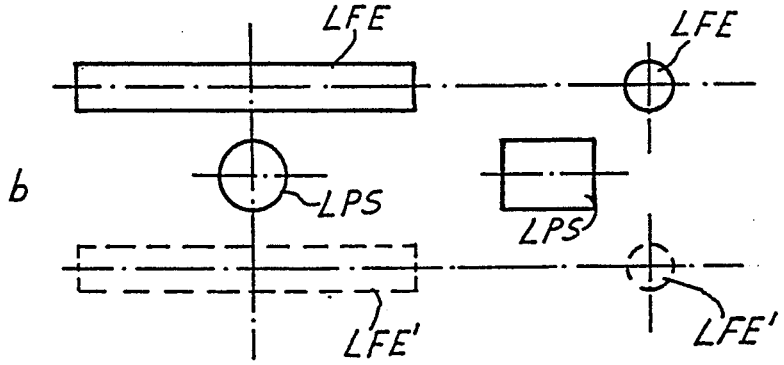
Figure 18C:
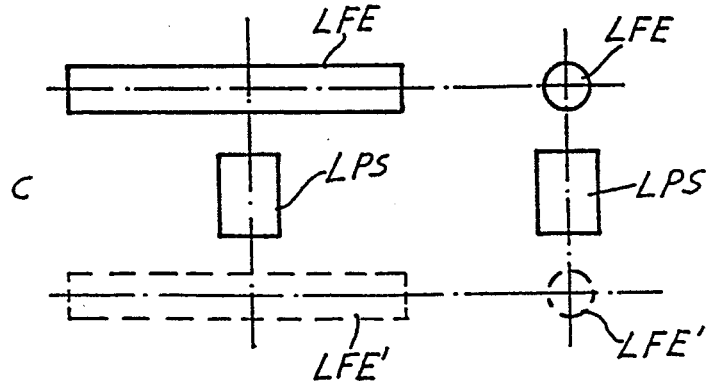

The antenna windings LSP and LFE are oriented perpendicularly to one another. Additionally, these antenna windings can be relatively oriented at other predetermined angular orientations falling within a limited range of degrees less than and greater than 90 degrees. For this reason, it is possible for the antenna winding LPS to selectively transmit to several traveling service units such as, for example, traveling service units specifically configured to restart a spinning operation or perform a package exchange operation, as illustrated in FIG. 18. Specifically, the respective antenna winding LFE of a traveling service unit can be disposed at substantially the same height as the antenna winding LPS, as illustrated in FIG. 18*a*, oriented at offset locations such as illustrated in FIG. 18*b* or oriented in a vertically superposed orientation as illustrated in FIG. 18*c*. The request by the respective work station for a particular traveling service unit can be accomplished through the transmittal of appropriate address data. By orienting the antenna winding LFE of a respective traveling service unit at an angle less than 90 degrees with respect to the antenna winding LPS of a work station, it is possible to produce, with a single apparatus, a signal operable through a relatively wide range to request servicing by a traveling service unit and to accomplish an exchange of data at a relatively great exchange speed. Because of the production of the variable voltage in the antenna winding LSP, it is possible for the antenna winding LSP to serve not only for positioning of the traveling service unit at the work station but also to serve as a receiver transmitter for the exchange of data.

The present invention also contemplates that a traveling service unit can provide a data storage capability by storing data transmitted thereto by a first work station and transmitting the stored data subsequently to a second work station.

As shown in FIG. 17*a*, the signal transmitted by the antenna winding LPS preferably has impulses having right angled shapes which can, for example, be impressed upon the signal transmitted by the antenna winding by a conventional drive step member. By virtue of the limited inductivity of the drive step member and the configuration of the antenna winding LFE, the antenna winding LFE transmits a signal having the form shown in FIG. 17*b*.

Figure 19:
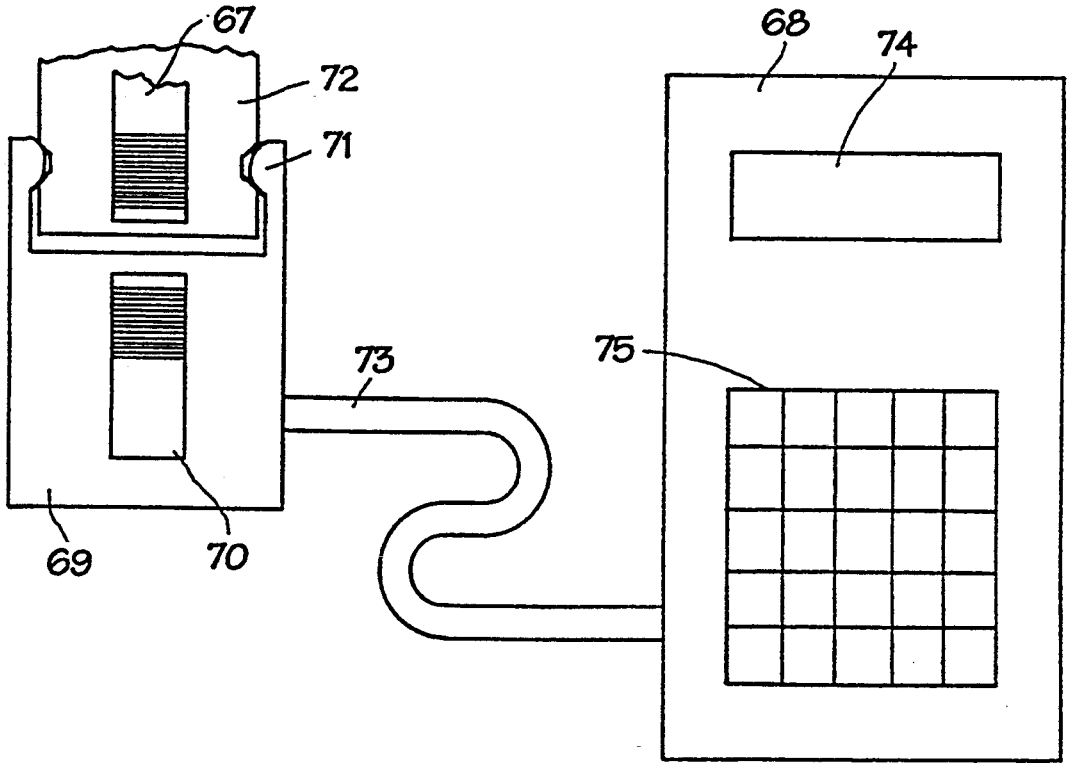
FIG. 19 is a front elevational view of a test device connected to an additional embodiment of the data exchange coordinating apparatus of the present invention.

In FIG. 19, an antenna 67 for transmitting a service request of a work station is illustrated. The antenna 67 can be cyclicly pulsed for a relatively short period of time with a request signal such as, for example, at a cycle of once every five hundred microseconds for a duration of ten microseconds. The request signals should preferably be of sufficiently limited duration that the positioning control means of an approaching traveling service unit does not respond to the request signal (i.e., hardware or software suppression means in the traveling service unit can be provided to block out such a short term request signal).

The present invention also contemplates that a data exchange operation can occur between a work station and a traveling service unit traveling past the work station. In this regard, the antenna for transmitting the request signal of the work station can be cyclicly pulsed for a very short time period request signal such as, for example, at the rate of once every five hundred microseconds for a duration of approximately ten microseconds.

The present invention additionally contemplates that a portable test apparatus can be provided to test the data transmission and receiving capabilities of a work station or a traveling service unit. As illustrated in FIG. 19, a portable external test apparatus 68 includes a display field 74 and an input means 75. The antenna 67 of a work station is provided with an adapter frame 72 having fastening recesses. An adapter 69 having an integrated winding 70 includes a fastening means 71 compatibly configured with the fastening recesses of the adapter frame 72 for selectively fixedly interconnecting the adapter 69 and the adapter frame 72 so that the antenna 67 and the integrated winding 70 are in a fixed predetermined relative orientation. The integrated winding 70 is operatively connected via a dual conductor cable 73 with the test apparatus 63.

Once the adapter 69 is coupled to the adapter frame 72, a short request signal can be transmitted by the antenna 67 to the integrated winding 70 and through the dual conductor cable 73 to the test apparatus 67. In response thereto, a longer request signal follows to signal the initiation of a data exchange between the test apparatus 68 and the work station for the purpose of analyzing the operation of the work station.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine of the type having a plurality of work stations for individually handling a textile material and at least one traveling service unit for servicing the work stations, the work stations having operating control means for controlling the operations of the work stations and the at least one traveling service unit having drive means for driving the service unit to and between the work stations along a travel path and control means for controlling the operation of the traveling service unit including means for controlling the drive means to effect positioning of the service unit at a service position at a respective work station for servicing of the work station by the service unit, a data exchange apparatus for effecting the exchange of data between the traveling service unit and a work station, comprising:

antenna means disposed on a selected one of the traveling service unit and a work station for the bidirectional exchange of data signals between the traveling service unit and the work station;

a pair of conductor means each for producing voltage in response to signals received from said antenna means, said conductor means being disposed on the other of the traveling service unit and the work station and being spaced from one another in generally linear alignment relative to the longitudinal extent of travel path of the traveling service unit;

voltage evaluating means communicated with said conductor means and the control means of the traveling service unit for evaluating the voltage produced by said conductor means;

work station signal means mounted to the work station and operatively connected to the operating control means of the work station for selectively transmitting signals to the traveling service unit from the operating control means using a selected one of said antenna means and said conductor means for receiving and relaying incoming signals from the traveling service unit to the operating control means; and service unit signal means mounted to the traveling service unit and operatively connected to the control means of the traveling service unit for selectively transmitting signals from the traveling service unit to the work station and for receiving signals from the work station operating control means, said work station signal means and said service unit signal means each being spaced a predetermined distance from one of said pair of conductor means and said antenna means associated with the respective work station and traveling service unit, said work station signal means and said service unit signal means each being operable to transmit and receive signals in wireless manner when they are positioned in operative alignment with one another within a predetermined spacing along the travel path of the traveling service unit, said antenna means, said pair of conductor means and said voltage evaluating means cooperating together to effect positioning of said work station signal means and said service unit signal means in operative alignment with one another with the voltage produced by each conductor means corresponding to the spacing between said antenna means and the respective conductor means such that the voltage produced correspondingly increases or decreases as the spacing between said antenna means and the respective conductor means increases or decreases and said conductor means each being operable to produce a characteristic voltage in correspondence with the alignment of said work station signal means and said service unit signal means in an operative alignment with one another and said voltage evaluating means being operable to signal the traveling service unit control means in response to a determination that an evaluated voltage corresponds to said characteristic voltage associated with each conductor means, each said characteristic voltage being representative of the operative alignment of said work station signal means and said service unit signal means, whereby the control means of the traveling service unit controls the drive means of the service unit to effect positioning of said work station signal means and said service unit signal means in operative alignment with one another for the exchange of data between the work station and the traveling service unit relating to the servicing requirements of the work station and the servicing operations of the service unit.

2. In a textile machine of the type having a plurality of work stations for individually handling a textile material and at least one traveling service unit for servicing the work stations, the work stations having operating control means for controlling the operations of the work stations and the at least one traveling service unit having drive means for driving the service unit to and between the work stations along a travel path and control means for controlling the drive means to effect positioning of the service unit at a service position at a respective work station for servicing of the work station by the service unit, a data exchange apparatus, comprising:

work station signal means operatively connected to the operating control means of a work station for selectively transmitting signals from the operating control means and for relaying signals to the operating control means;

service unit signal means operatively connected to the control means of the traveling service unit for selectively transmitting signals from the traveling service unit and for receiving signals from the work station signal means, said work station signal means and said service unit signal means defining a system for the wireless, bi-directional transmission of signals between the work station and the traveling service unit whereby data relating to the servicing requirements of the work station and the servicing operations of the service unit are exchanged between the work station and the service unit;

at least one antenna mounted on a selected one of the traveling of service units and a work station;

at least two conductor means for producing voltage in response to the inducing of voltage therein by said at least one antenna, said at least two conductor means being disposed on the other of the traveling service unit and the work station and said at least two conductor means being spaced from one another in generally linear alignment relative to the longitudinal extent of the travel path of the traveling service unit, the magnitude of the voltage induced in each said conductor means corresponding to the relative spacing of said at least one antenna therefrom such that the voltage induced in each said conductor means correspondingly increases or decreases as the spacing between said at least one antenna and each said conductor means respectively increases or decreases and each said conductor means being operable to produce a voltage having a characteristic value when said work station signal means and said service unit signal means are operatively aligned for the wireless bi-directional transmission of signals therebetween; and voltage evaluating means in communication with said at least two conductor means for comparing the voltage produced by each of said at least two conductor means with their associated characteristic voltage values, said voltage evaluating means being in communication with the drive control means of the traveling service unit for control of the traveling movement of the traveling service unit by the drive control means in response to signals received from said voltage evaluating means, and the drive control means controlling the traveling service unit to move along the travel path to effect positioning of the traveling service unit in an aligned position with the work station.

3. A textile machine data exchange apparatus according to claim 2 wherein said antenna means includes a coil having a conductive core, said core having a longitudinal axis and said at least two conductor means being disposed at generally right angles to said longitudinal axis of said core of said antenna means.

4. A textile machine data exchange apparatus according to claim 2 wherein said at least two conductor means are disposed relative to one another in a manner that when passing said antenna means at a predetermined distance, said signals induced in each of said at least two conductor means are in phase and applied to said voltage evaluating means as a signal indicative of the positional deviation of said traveling service unit from an operatively aligned portion with the work station, said voltage evaluating means including a rectifier circuit for producing a direct current voltage having a first polarity corresponding to a positional deviation in a first direction and a second polarity corresponding to a positional deviation in a second direction, said direct current voltage being applied to said drive control mean to control the movement of said traveling service unit into operative alignment with the work station for data exchange with the work station.

5. A textile machine data exchange apparatus according to claim 2 and further comprising at least two receiving antennas, at least one of said receiving antennas for receiving signals from said at least one antenna being disposed outwardly in a first direction from said conductor means with respect to the longitudinal extent of the travel path and at least one receiving antenna being disposed outwardly in a second direction from said conductor means with respect to the longitudinal extent of the travel path, said receiving antennas being operatively connected to the drive control means, said drive control means acting to slow the movement of the traveling service unit responsive to signals from said receiving antennas indicating that said traveling service unit is a predetermined distance from said work station.

6. A textile machine data exchange apparatus according to claim 5 wherein said textile machine includes a plurality of traveling service units and each traveling service unit has detection means operatively connected to said receiving antennas and said conductor mean, said detection means controlling action of the drive control means and being responsive to a frequency of a signal transmitted from a work station which i different from frequencies to which other traveling service units respond.

7. A textile machine data exchange apparatus according to claims 2 wherein said textile machine includes a plurality of traveling service units and each work station includes a plurality of transmitting antennas in addition to said at least one antenna, each transmitting antenna transmitting a signal at a single frequency unique to that antenna and different from the transmission frequency of the other said transmitting antennas and said conductor means being disposed at a location on said traveling service units for free movement of said traveling service units by work stations transmitting at a frequency different from that to which the traveling service unit will respond and for free movement by other traveling service units.

8. In a textile machine of the type having a plurality of work stations for individually handling a textile material and a plurality of independently operating traveling service units for individually and independently servicing the work stations, each work station having control means for controlling the operations of the work stations and each traveling service unit having means or driving each service unit to and from selected work stations along a travel path and control means for controlling the drive means to move the service unit to a predetermined service position at a respective work station for servicing of the work station by the service unit, a data exchange apparatus for the independent exchange of data between a selected one of the traveling service units and a selected one of the work stations, said data exchange apparatus comprising:

work station transmitter means mounted to each work station and communicating with the work station control means for generating and transmitting hailing signals, positioning signals and data signals responsive to predetermined input signals from the work station control means;

service unit receiver means mounted to each service unit and communicating with the service unit control means for receiving said hailing signals, positioning signals and data signals from said work station transmitter means and communicating said signals to the service unit control means for controlling movement and operation of the service unit responsive to signals received by said service unit receiver means;

service unit transmitter means mounted to each service unit and communicating with the service unit control means for transmitting data signals responsive to predetermined input signals from the service unit control means; and work station receiver means mounted to each work station and communicating with the work station control means for receiving data signals from said service unit transmitter means and communicating said data signals to the work station control means for controlling operation of the work station responsive to data signals received from the traveling service unit; said work station transmitter means, said work station receiver means said service unit transmitter means and said service unit receiver means cooperating to form a transceiver system for the hailing of a selected traveling service unit by a selected work station, moving a selected traveling service unit to the predetermined service position at a selected work station along the travel path and the exchange of data between the selected work station and the selected traveling service unit independently of other work stations and traveling service units and without intentional contact between the work station and the service unit.

9. A data exchange apparatus according to claim 8 wherein said work station transmitting means and said service unit transmitting means include induction coils for generating a pulsating magnetic field in response to signals from said respective work station control means and said service unit control means; and said work station receiving means and said service unit receiving means include induction coils for generating a voltage in response to said pulsating magnetic field, said voltage being communicated to the respective work station control means and the service unit control means.

10. A data exchange apparatus according to claim 9 wherein said work station transmitting means and said service unit transmitting means include means for producing a pulsating magnetic field which for detection by said respective service unit receiving means and said work station receiving means at a range of not greater than one meter.

* * * * *